US005519954A

United States Patent [19]

Garrett

[11] Patent Number: 5,519,954

[45] Date of Patent: May 28, 1996

[54] AMBIDEXTROUS MAGAZINE RELEASE MECHANISM FOR FIREARMS

[76] Inventor: Robert H. Garrett, 8191 Barnwood Rd., Manassas, Va. 22111

[21] Appl. No.: 492,437

[22] Filed: Jun. 19, 1995

[51] Int. Cl.[6] ..... F41C 27/00

[52] U.S. Cl. ..... 42/6

[58] Field of Search ..... 42/6, 7, 18, 22; 89/33.1, 197

[56] References Cited

U.S. PATENT DOCUMENTS

| | | | |
|---|---|---|---|
| 1,069,339 | 8/1913 | Layman | 42/18 |
| 1,368,719 | 2/1921 | Hammond | 42/7 |
| 1,452,042 | 4/1923 | Hammond | 42/7 |
| 3,568,348 | 3/1971 | Wilhelm | 42/7 |
| 4,429,479 | 2/1984 | Johnson | 42/6 |
| 4,521,985 | 6/1985 | Smith et al. | 42/7 |
| 4,615,134 | 10/1986 | Beretta | 42/6 |
| 4,638,581 | 1/1987 | Moore | 42/7 |
| 4,713,902 | 12/1987 | Wigton | 42/7 |
| 4,759,144 | 7/1988 | Egan et al. | 42/7 |
| 4,835,892 | 6/1989 | Ruger et al. | 42/7 |

FOREIGN PATENT DOCUMENTS

| | | | |
|---|---|---|---|
| 364408 | 4/1990 | European Pat. Off. | 42/7 |

OTHER PUBLICATIONS

Brochure on G41 Rifle, by Heckler and Koch (1985).

NRA Publication, "Semi–Auto Rifles" by R. W. Hunnicutt (1988) p. 48.

*Primary Examiner*—Stephen C. Bentley

[57] ABSTRACT

The present invention relates to an improved retaining and release mechanism for the magazines of automatic and/or semi-automatic firearms, in particular to a type of magazine which is provided with a lateral securing slot. A tooth (52) of lever (54) is designed to engage lateral securing slot (34) of magazine (30). Said lever (54) is provided with a deflecting surface (55) which abuts to a pair of deflecting edges (**57*a*,57*b*) of protective ears (56*a*,56*b*). Said lever (54) is pivotally connected to said protective ears (56*a*,56*b*) of a base (38) by means of a pin (58). A slide (62) is connected to a "T" shaped guide (60), of said lever (54), by means of a "T" shaped channel (64). Said lever (54) is urged towards a body (16) of the firearm by energy exerted through a plunger (82) from a plunger spring (80) contained within said shaft (36). This spring energy is also used to hold said slide (62) in a retracted position over locking shelves (70*a*,70*b*) by means of a detent "A" (92), or in an extended position by means of a detent "B" (94) of said slide (62). Said base (38) is attached to a spring loaded shaft (36) located transversely in body (16) of the firearm and attached at its opposite end to an operating push button (44). The tooth (52) can be disengaged from lateral securing slot (34) by depressing either operating push button (44) or slide (62). The present invention's ambidextrous function can be engaged or disengaged by extending or retracting, respectively, slide (62) over locking shelves (70*a*,70*b*). The magazine (30**) can thus be released from both sides of the rifle.

20 Claims, 11 Drawing Sheets

AMBIDEXTROUS MAGAZINE RELEASE MECHANISM FOR FIREARMS

BACKGROUND—FIELD OF INVENTION

The present invention relates to improvements of mechanisms used to retain or release magazines of automatic and/or semi-automatic firearms.

BACKGROUND

The use of a catch or latch to retain and/or release a magazine with a lateral securing slot in automatic and/or semi-automatic firearms, such as the "standard NATO 0.223", is known. Many firearms already incorporate the use of a hook or catch which operates in a recess allowing for its engagement into the magazine thereby securing the magazine in the firearm.

The hook or catch is typically attached to a rod or shaft which is guided transversely through the body of the weapon and secured to a push-button. A spring, located around the shaft, is used to hold an engagement tooth of the hook in a position that secures the magazine. Depressing of the push-button towards the body of the rifle forces the hook or catch away from the lateral securing slot, releasing the magazine from the firearm.

This push-button is usually located on the right side of the firearm and is, in some circumstances, difficult to operate by "left-handed" shooters.

There are several accepted methods of removal and replacement of magazines. The "European Method" stresses the need to maintain the expended magazine on one's person. European firearms have a magazine release that is located conveniently close to the magazine well. The "European" soldier, therefore, is trained to cradle the weapon with his "non-firing" hand, remove his "firing-hand" from the pistol grip, place his "firing-hand" around the magazine body and use the thumb of the "firing-hand" to actuate a magazine release button. The soldier then places the spent magazine in a magazine pouch and uses this same "firing-hand" to retrieve a loaded magazine. The "firing-hand" is again used to insert the loaded magazine into the weapon. Then, the "firing-hand" is placed back on the pistol grip, the bolt is released and the soldier is free to re-acquire and engage targets.

The "American Method" stresses the importance of speed during a magazine change. The M16 and AR-15 rifles are provided with a magazine release that is situated so that the soldier can readily depress it with the index finger of his "firing-hand" while in its normal position on the pistol grip. In this manner, the soldier has the ability to release a magazine with the index finger of his "firing-hand", allowing the spent magazine to fall away, while simultaneously retrieving a loaded magazine with his "non-firing" hand. This "non-firing" hand inserts the loaded magazine, releases the bolt and the shooter need only move his index finger back to the trigger to re-engage targets. It is obvious that this method of changing a magazine requires much less time to execute than the "European Method" described above.

Both of the methods described above were developed for a "right-handed" shooter firing a weapon designed for a "right-handed" shooter. The "left-handed" shooter, using a firearm designed for a "right-handed" shooter, must use his "non-firing" hand to change magazines while his "firing-hand" is maintained on the pistol grip. In doing so, he must first depress the existing magazine release with the thumb of his "non-firing" hand and remove the spent magazine before he can use the same "non-firing" hand to retrieve and insert a loaded magazine. As you can see, the "American Method" for the "right-handed" shooter is, again, much more expedient. It is, therefore, important to provide a firearm with a magazine release mechanism that is operable in a like manner for both "left-handed" and "right-handed" shooters. This ambidextrous release mechanism must also be constructed so that it is easily depressed by the index finger of the "firing-hand" while in its normal position on the pistol grip.

The need for an ambidextrous magazine release is not limited to the "left-handed" shooter alone. Often times, in a combat situation, a soldier is forced to switch from his dominant shooting posture to take advantage of cover and concealment. The act of changing a magazine in this less familiar posture can cost the soldier valuable time when trying to reload his weapon.

An injury sustained by a soldier could also change his dominant shooting posture. The loss of a dominant eye or digits of his "firing-hand" may force him to use a weaker position. A wounded hand could still be used to steady the weapon and perform the less complicated task of replacing a magazine.

When a shooter uses a sling to better stabilize his position, the "non-firing" hand is physically "bound" to the forearm by the sling. The "right-handed" shooter must use his "firing-hand" to remove and replace an expended magazine. The "left-handed" shooter, using a firearm designed for a "right-handed" shooter, is forced to assume an extremely awkward position, often times having to reach over the entire weapon to release and remove a spent magazine. This excess movement takes valuable time and reduces the "left-handed" shooter's ability to re-engage targets at the same speed as his "right-handed" counterpart.

It should be clear to the reader that an ambidextrous magazine release mechanism must not only be easily accessible by the index finger of either "firing" hand while that "firing-hand" is maintained on the pistol grip, but it must also be equally accessible to the thumb of the "firing" or "non-firing" hand that is used to both remove and replace a magazine.

BACKGROUND—DESCRIPTION OF PRIOR ART

Inventors have created several types of ambidextrous magazine release/retaining mechanisms to enable "left-handed" shooters to use the same firearm as "right-handed" shooters.

One invention, U.S. Pat. No. 4,429,479 to Johnson, seeks to provide rifles, like the Heckler and Koch Models 91 and 93, with a mechanism that enables a "right-handed" shooter to release and remove a magazine with the "non-firing" hand. A pivotal assembly, with a depressable extension, is attached to the transversely located shaft of the existing magazine release. When depressed, the pivotal assembly "cams" against an inside "stamped metal" wall of the firearm, causing the shaft to move in the direction necessary to disengage the hook from the lateral securing slot of the magazine. The extension is designed to be depressed with the thumb of the "non-firing" hand while it is positioned around the magazine. This requires the extension to be located conveniently close to the magazine well. The operation of this invention depends on the extension being located behind the magazine and under the firearm. A "left-handed" shooter can change magazines in a similar manner. The "left-handed" shooter simply depresses the existing operating push button, located near the magazine well, with the thumb of his "non-firing" hand. This invention does provide an ambidextrous means of magazine removal. It still fails, however, to provide the shooter access to the magazine release with the index finger of the "firing-hand" while in its normal position on the pistol grip. The shooter is still required to use his "non-firing" hand to remove and secure the magazine before he can use the same "non-firing hand" to retrieve and install the fresh magazine into the firearm. It is obviously faster to release the magazine with the finger of the "firing-hand", allowing the magazine to fall away, while simultaneously retrieving and installing a loaded magazine with the "non-firing" hand. As stated, this invention requires a portion of the assembly to "pivot" against a inside wall of a "stamped metal" body. Since the majority of the firearms using the "standard NATO 0.223" magazine are machined from a block of aluminum alloy, it is clear that there is no cavity in which to house or operate this invention. Another disadvantage of this invention is the fact that its operation depends upon "camming" against the body of the firearm. This "camming" action could lead to premature wear of the body of the firearm requiring costly replacement. The installation or "retro-fitting" of this assembly would be complicated, requiring tools and a limited amount of expertise.

Another invention, U.S. Pat. No. 4,615,134 to Beretta, was designed to enable a "right-handed" shooter to release a magazine when a buttstock is folded against the body of a receiver, blocking a "right-hand" biased magazine release button. This invention also depends upon a "camming" action against the body of the firearm which could cause premature wear. A rocking lever, located on the left side of the firearm, is pivotally connected to the magazine catch. When a pressable portion, located on the forward end of the rocking lever, is depressed, the assembly "cams" against the body of the firearm lifting the catch away from the magazine. The major disadvantage of this mechanism is the location of the pressable portion forward and away from the pistol grip. This configuration cannot be operated by the index finger of the "firing-hand" while in its normal position on the pistol grip. As previously discussed, the shooter must be able to depress the magazine release with the index finger of his "firing-hand", while in its normal position on the pistol grip, in order to execute the fastest possible magazine change. The lever is not protected and is susceptible to accidental release by lying the firearm on its side or by being struck with equipment that is worn by a soldier. Another disadvantage of the forward location of the lever is that it creates a "fork" which will be prone to snagging by foliage and equipment. The invention also does nothing to alleviate the difficulty of a "right-handed" shooter to change a magazine when the stock is folded against the body of the firearm, one of the invention's principal aims. When the stock is folded against the body of the weapon, either partially or fully concealing the magazine release button, the "non-firing" hand is used to hold the firearm and the "firing-hand" is used to execute the magazine change. The invention, U.S. Pat. No. 4,615,134 to Beretta, only provides the "left-handed" shooter full access to a magazine release when the stock is folded in the manner described above. It is clear that this invention is not truly ambidextrous.

OBJECTS AND ADVANTAGES

Accordingly, one of the objects of my ambidextrous magazine release mechanism is to overcome the disadvantages mentioned above and to provide a mechanism that can be easily manipulated by "left-handed" or "right-handed" shooters employing all of the methods of changing a magazine previously discussed. Another object of the invention is to provide an improved magazine retaining and release mechanism that is readily adaptable to existing assemblies without the need for alteration of the firearm. My invention's "self-contained" design makes installation quick and easy, requiring only a simple tool and no expertise. Yet another object of the essentially "self contained" design of my ambidextrous magazine release, is to eliminate damage caused to the body of the firearm by the "camming" action found in existing inventions.

One major disadvantage of "ambidextrous" assemblies, not previously discussed, is the problem encountered when "rigging" the firearm to a "Paratrooper's Harness" for "airborne" operations. Typically, "elite forces" do not place their firearms in containers, as do members of conventional airborne units, when preparing for a deployment. These "elite forces" choose to secure the firearm directly to the harness so that it is easier to acquire once the paratrooper recovers from his landing. A "main strap" is used to secure the firearm against the soldier. Since it is preferable to have a loaded magazine in the firearm, it becomes clear that the location of a magazine release, on the side of the firearm resting against the soldier, makes it prone to accidental release. It is yet a further object of my invention to provide an assembly that is "lockable" to reduce the possibility of accidental release. The invention will incorporate a self-contained or disposable "locking system" which can be easily disengaged by the soldier once he recovers from his parachute landing. The invention will also incorporate design features to make it less prone to accidental release, when "un-locked", and snagging by foliage and equipment.

BRIEF DESCRIPTION OF THE DRAWINGS

The present invention will now be described further by way of example, with reference to the accompanying drawings, in which.

REFERENCE NUMERALS IN DRAWINGS

Figure 1:
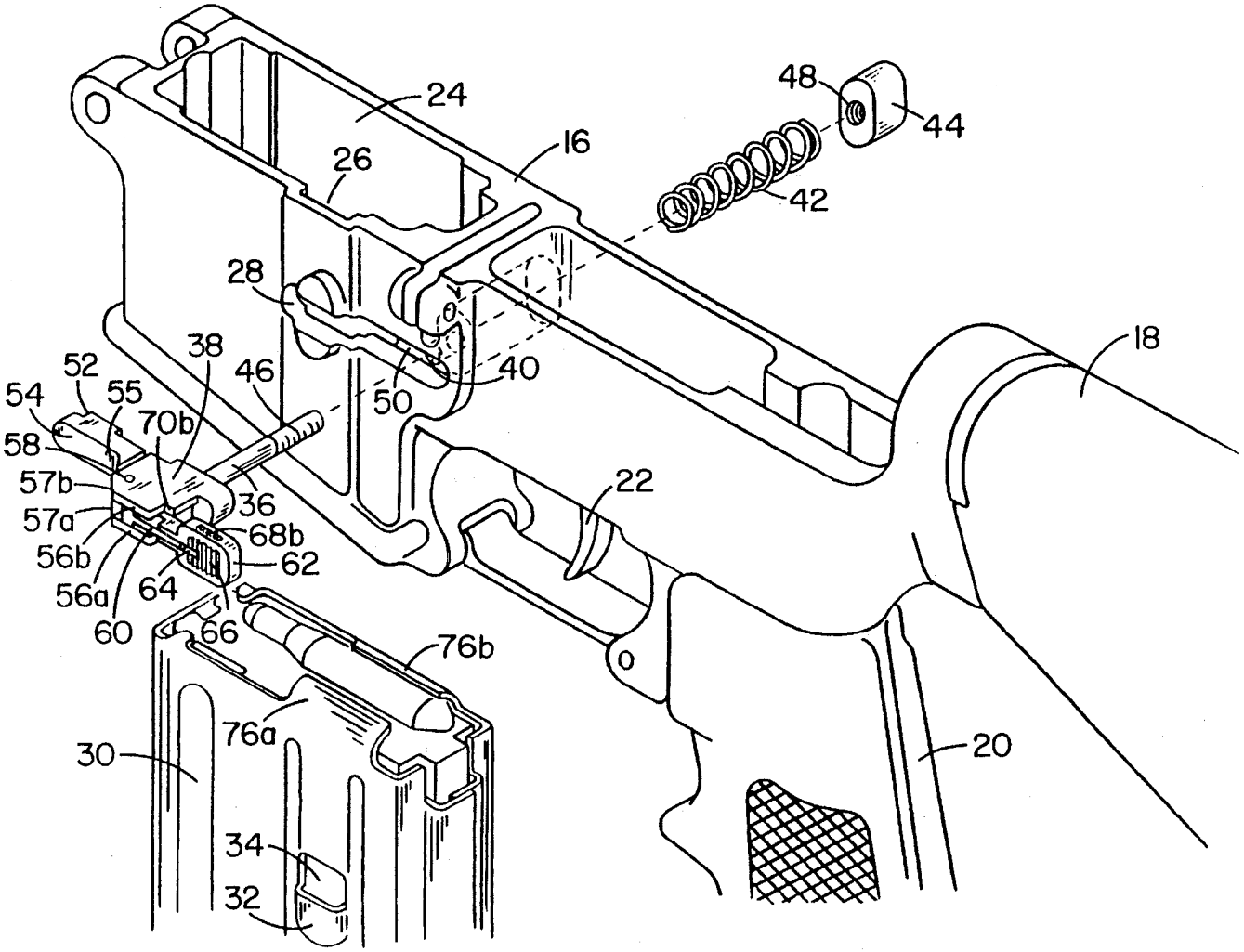
FIG. 1 is a left side perspective view of a rifle.

| Reference Numerals in Drawings | |
|---|---|
| 16 | body |
| 18 | buttstock |
| 20 | pistol grip |
| 22 | trigger |
| 24 | magazine well |
| 26 | alignment recess |
| 28 | magazine catch slot |
| 30 | magazine |
| 32 | alignment protrusion |
| 34 | lateral securing slot |
| 36 | shaft |
| 38 | base |
| 40 | orifice |
| 42 | spring |
| 44 | operating push button |
| 46 | threaded portion |
| 48 | threaded hole |
| 50 | seat |
| 52 | tooth |
| 54 | lever |
| 55 | deflecting surface |
| 56a | protective ear (left) |
| 56b | protective ear (right) |
| 57a | deflecting edge (left) |
| 57b | deflecting edge (right) |
| 58 | pin |
| 60 | "T" shaped guide |
| 62 | slide |
| 64 | "T" shaped channel |
| 66 | main knurled surface |
| 68a | side knurling (left) |
| 68b | side knurling (right) |
| 70a | locking shelf (left) |
| 70b | locking shelf (right) |
| 72 | elongated recess |
| 74 | spring cavity |
| 75 | bevel |
| 76a | feed lip (left) |
| 76b | feed lip (right) |
| 78 | plunger cavity |
| 80 | plunger spring |
| 82 | plunger |
| 84 | mortise |
| 86 | tennon |
| 88a | opening (left) |
| 88b | opening (right) |
| 90 | hole |
| 92 | detent "A" (rear) |
| 94 | detent "B" (front) |
| 96 | stop shelf |
| 98 | slide stop |
| 100 | pivotal lock |
| 102 | pivot pin |
| 103 | one-piece lever |
| 104a | ball detent (front) |
| 104b | ball detent (rear) |

-continued

| Reference Numerals in Drawings | |
|---|---|
| 105 | depressable portion |
| 106 | housing slot |
| 107a | notch (left) |
| 107b | notch (right) (not shown) |
| 108 | removable lock (polymer) |
| 110 | serrated surface |
| 112 | tab |
| 114a | stationing protrusion (right) |
| 114b | stationing protrusion (left) |
| 116 | pull ring |
| 118 | elongated operating push button |
| 120 | securing pin |
| 122 | half-moon protrusion |
| 124 | half-moon socket |
| 126 | pressable end |

DESCRIPTION OF THE PREFERRED EMBODIMENT—FIGS. 1–5

Figure 2:
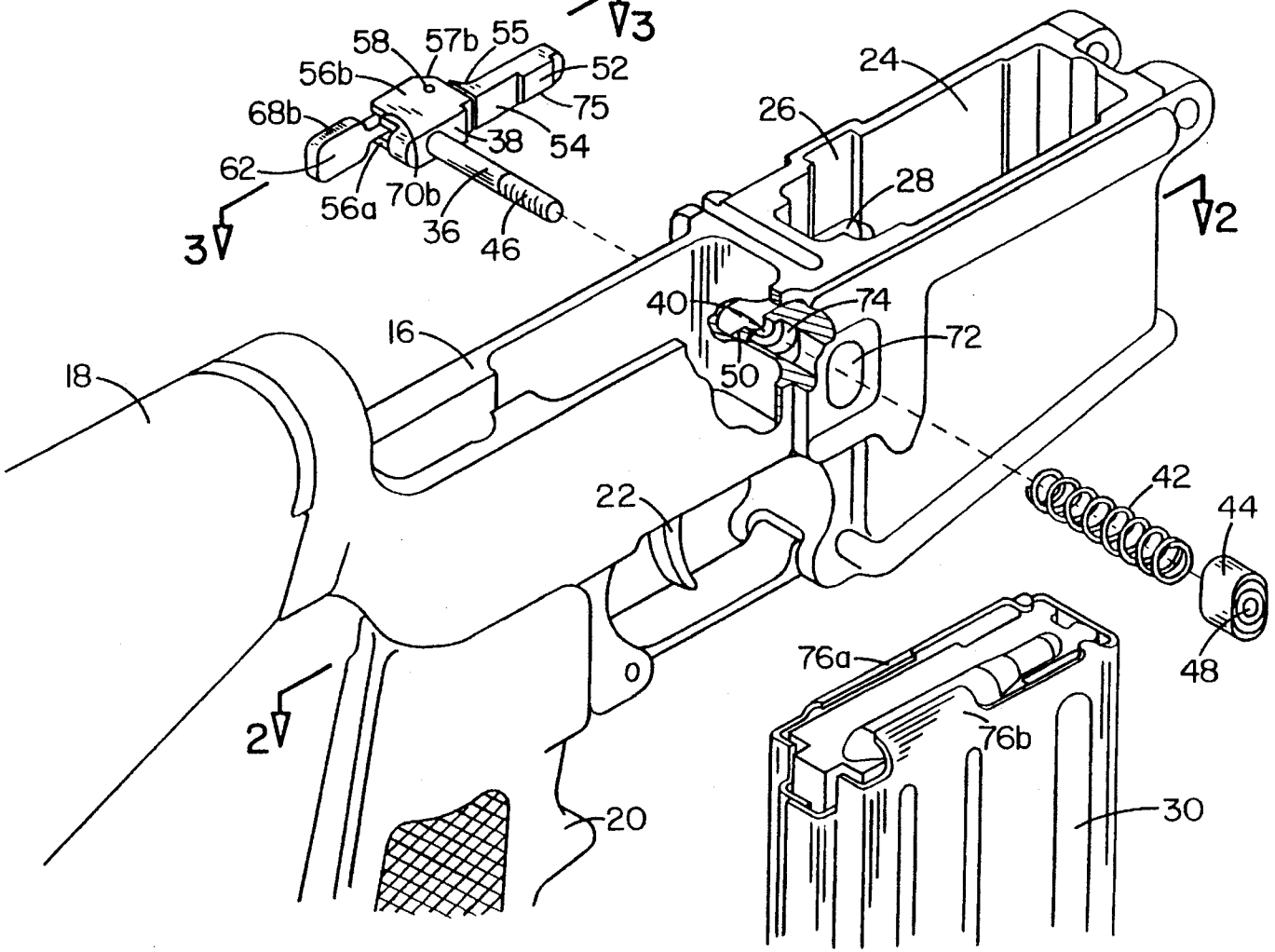
FIG. 2 is a right side perspective view of a rifle.

In FIG. 1 and FIG. 2 a lower receiver or body 16 of an automatic or semi-automatic rifle is shown including a buttstock 18, a pistol grip 20, a trigger 22, and a magazine well 24. Within magazine well 24 is an alignment recess 26 and an adjacent magazine catch slot 28. A magazine 30 is guided into magazine well 24 by an alignment protrusion 32 which travels along an alignment recess 26. When magazine 30 is fully seated in magazine well 24, a lateral securing slot 34 coincides with magazine catch slot 28. A shaft or rod 36, which is attached to base 38, is guided transversely through an orifice 40, a spring 42, and is connected to an operating push button 44 by means of a threaded portion 46 which is screwed into a threaded hole 48 extending through operating push button 44. Spring 42, acting against operating push button 44 and spring cavity 74, urges base 38 towards body 16 within magazine catch slot 28. Base 38 comes to rest on a seat 50 allowing for the engagement of a tooth or catch 52, of a lever 54, with lateral securing slot 34 of magazine 30. Lever 54 is pivotally connected to a pair of protective ears **56*a* and 56*b*, of base 38, by means of a pin 58 forming a "trunnion". A radius or deflecting surface 55 abuts to a pair of deflecting edges 57*a* and 57*b*, of protective ears 56*a* and 56*b* respectively, providing a "flowing" connection of lever 54 and base 38 that will be less prone to snags from foliage and equipment. The height of protective ears 56*a* and 56*b* above lever 54, provides a surface or guard which limits access to a pressable portion or slide 62. The upper plane formed by protective ears 56*a* and 56*b* occurs higher than the upper plane of slide 62, thus reducing the possibility of accidental release by laying the rifle on its side or impact from equipment. A "T" shaped guide 60 is provided at the rear of lever 54 that fits securely into a "T" shaped channel 64 of slide 62. Slide 62 is provided with a main knurled surface 66 to aid in the depression of slide 62, when it is in an "unlocked" or extended state. Slide 62 also provides a side knurling 68*a* and 68*b* to aid in the extension and retraction of slide 62 on guide 60. When slide 62 is retracted, or in a "locked" state, a pair of locking surfaces 70*a* and 70*b*, of protective ears 56*a* and 56*b* respectively, physically block downward rotation of slide 62. A pair of feeding lips 76*a* and 76*b* are formed in the construction of magazine 30. The outer radius of feeding lip 76*a* contacts a bevel 75 of tooth 52 allowing tooth 52 to "ride-over" magazine 30 pushing tooth 52 out of magazine well 24 when magazine 30 is inserted into magazine well 24. Tooth 52 slides along the outside of magazine 30 until lateral securing slot 34 coincides with magazine catch slot 28. Energy from a plunger spring 80, shown in FIG. 3, is transferred through a plunger 82, also shown in FIG. 3, to the underside of slide 62 urging tooth 52 of lever 54 into the aligned lateral securing slot 34 of magazine 30**.

FIG. 2 shows clearly a spring cavity 74 for alignment of spring 42. An elongated recess 72 allows for sufficient depression of operating push button 44 into body 16 to accommodate the rotation of base 38 when connecting threaded portion 46 of shaft 36 to threaded hole 48 of operating push button 44. When a sufficient number of rotations of base 38 are achieved to completely engage threaded portion 46 within threaded hole 48, base 38 and lever 54 are aligned with magazine catch slot 28 and operating push button 44 is released. Outward extension of spring 42 acting against spring cavity 74 and operating push button 44 urges base 38 towards body 16 until base 38 comes to rest on seat 50, allowing for full engagement of tooth 52 with lateral securing slot 34 of magazine 30. The elongated shape of recess 72 also acts to restrict radial movement and rotation of operating push button 44 eliminating the need for hardware to fix operating push button 44 to shaft 36.

Figure 3:
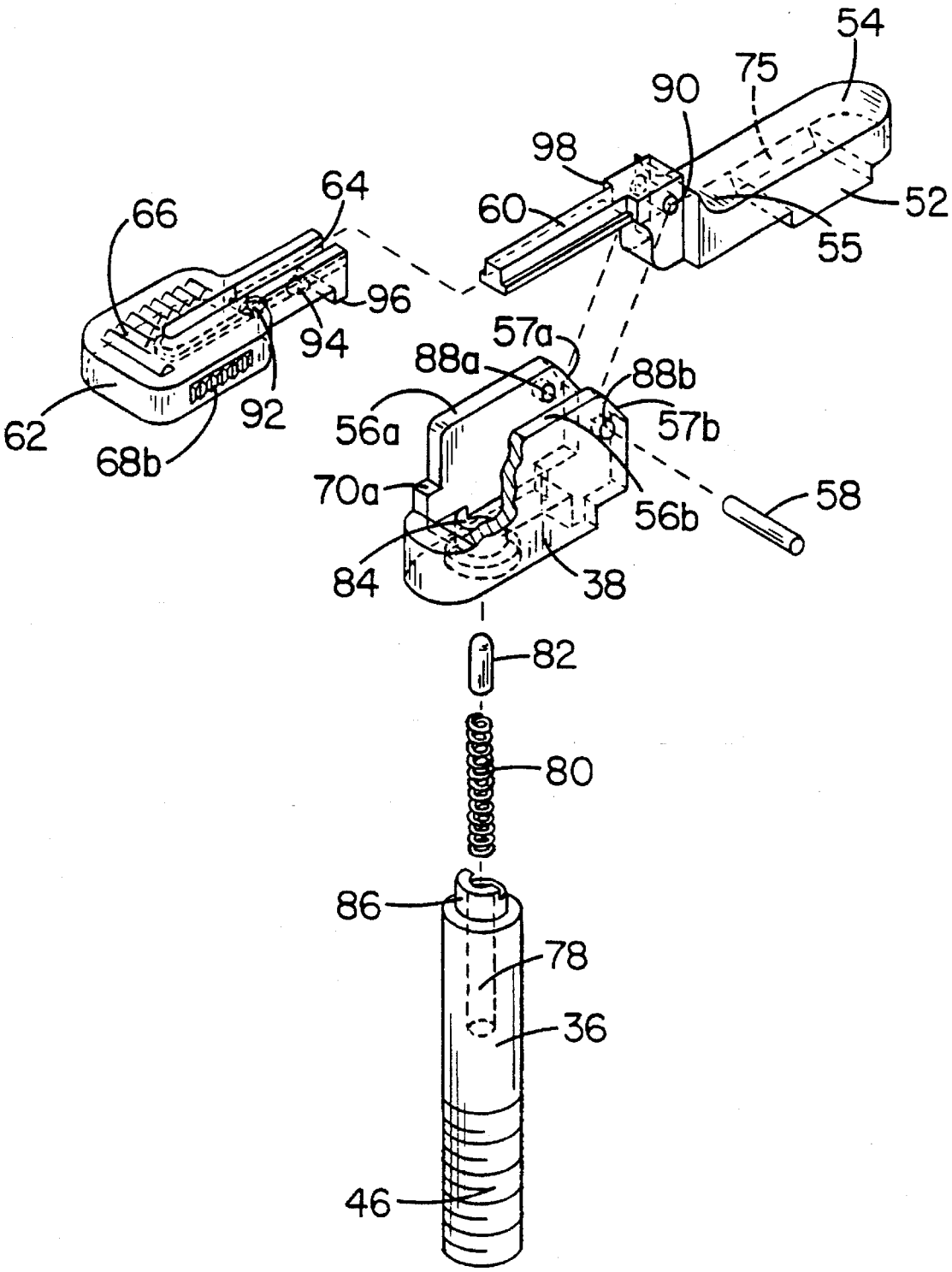
FIG. 3 is an exploded view of the preferred embodiment.
Figure 4:
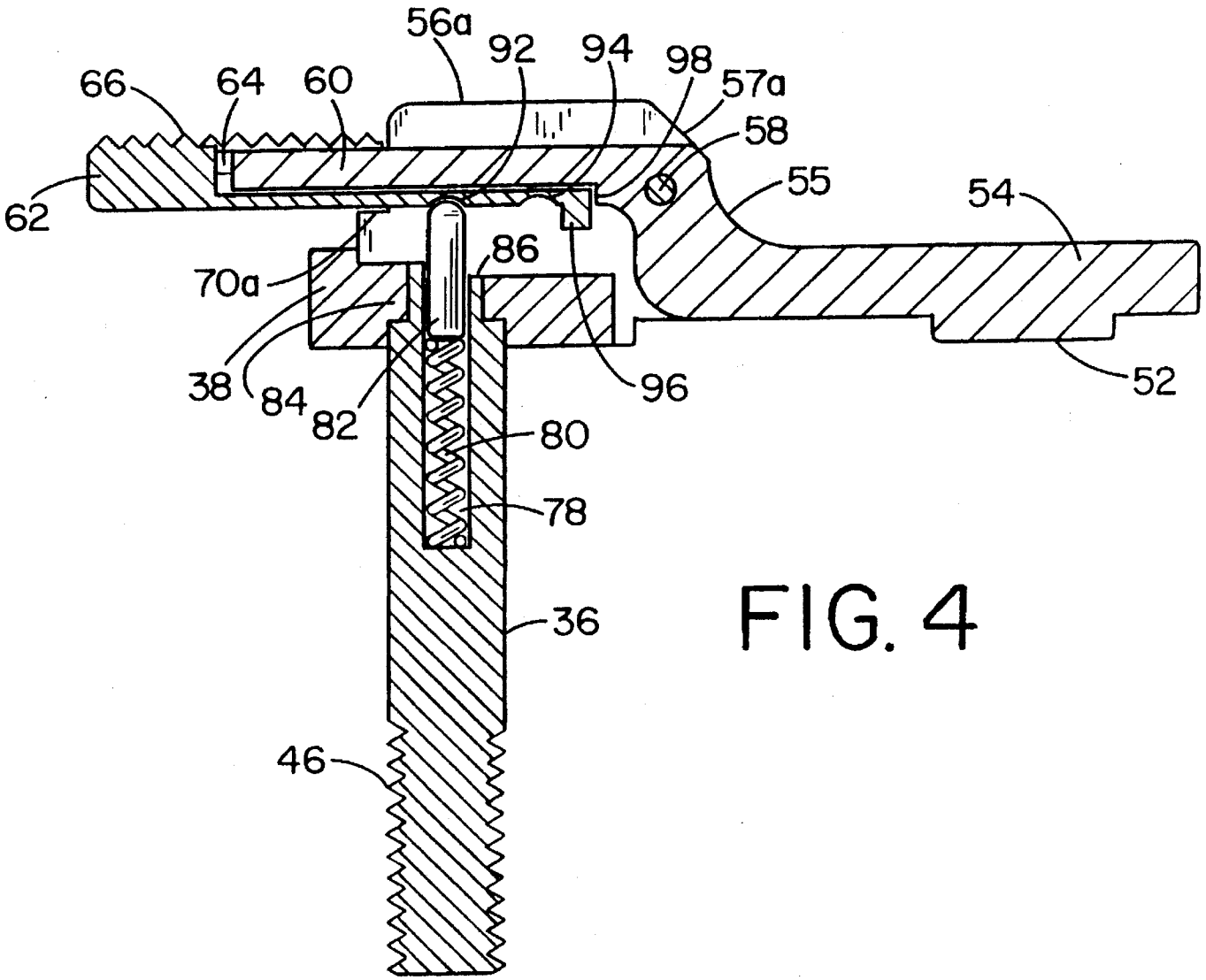
FIG. 4 is a sectional view taken along the line 3—3 of FIG. 2, showing my magazine release in a "locked-out" state.
Figure 5:
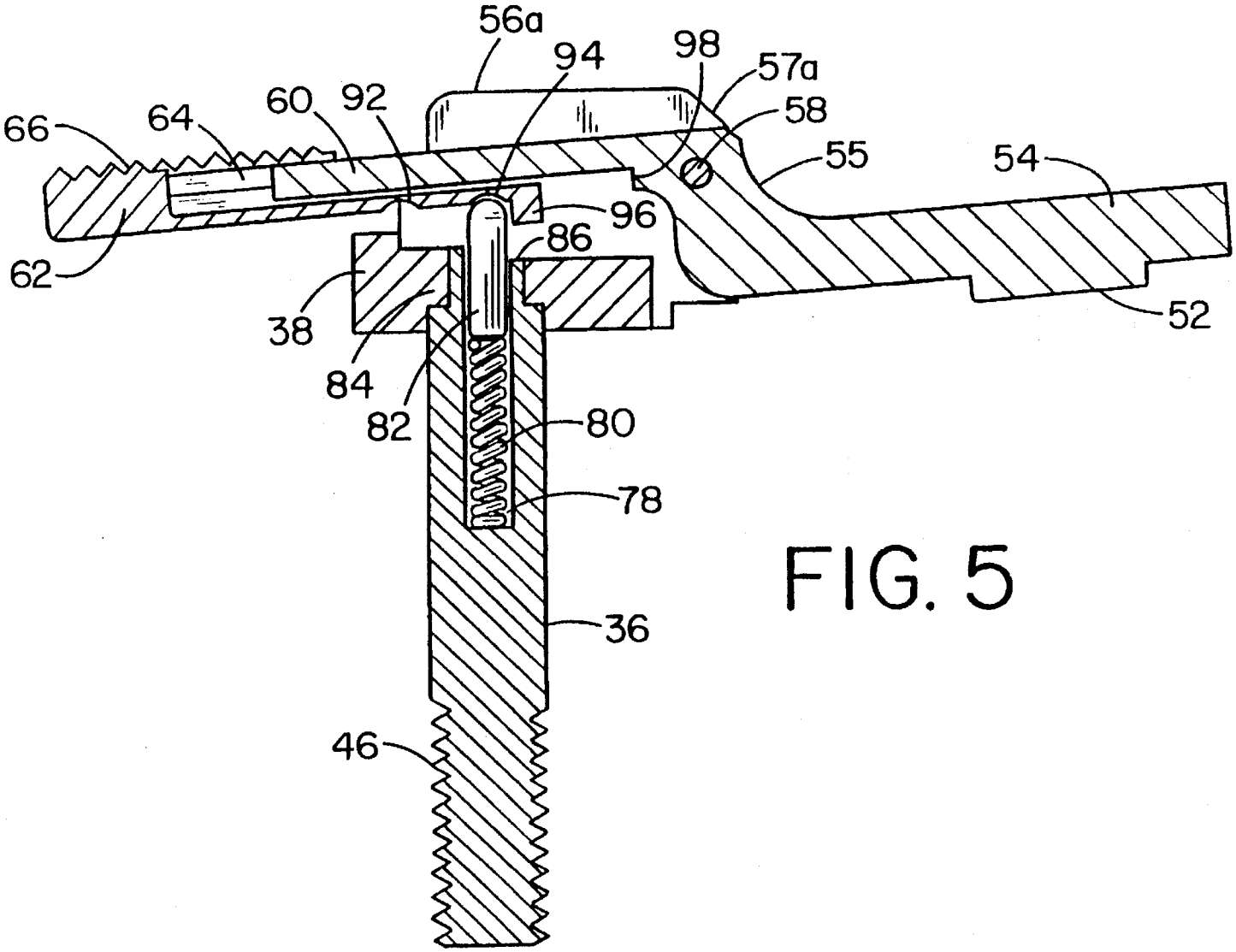
FIG. 5 is a similar sectional view taken along line 3—3 of FIG. 2, showing my magazine release "un-locked" and "depressed"

FIGS. 3–5 show a plunger cavity 78 within shaft 36 which houses plunger spring 80 and plunger 82. One method of affixing shaft 36 to base 38 is depicted where a mortise 84 within base 38 accepts a tennon 86 of shaft 36. Once mated, shaft 36 could be "silver soldered" or welded to base 38. Shaft 36 and base 38 could also be machined or cast as a single unit. FIG. 3 also shows a pair of openings **88*a* and 88*b* made in protective ears 56*a* and 56*b* respectively, which align with hole 90 of lever 54 to accept a pin 58** forming a "trunnion".

In FIG. 4 (locked position) plunger 82 is shown engaging a detent "A" 92 which holds slide 62 in a "retracted" position. A stop shelf 96 abuts slide stop 98 limiting forward movement of slide 62.

In FIG. 5 (unlocked position) plunger 82 is shown engaging a detent "B" 94 which holds slide 62 in an "extended" position. Slide 62 is fully extended and stop shelf 96 contacts plunger 82 limiting rearward movement of slide 62.

OPERATION—FIGS. 6–8

Figure 6:
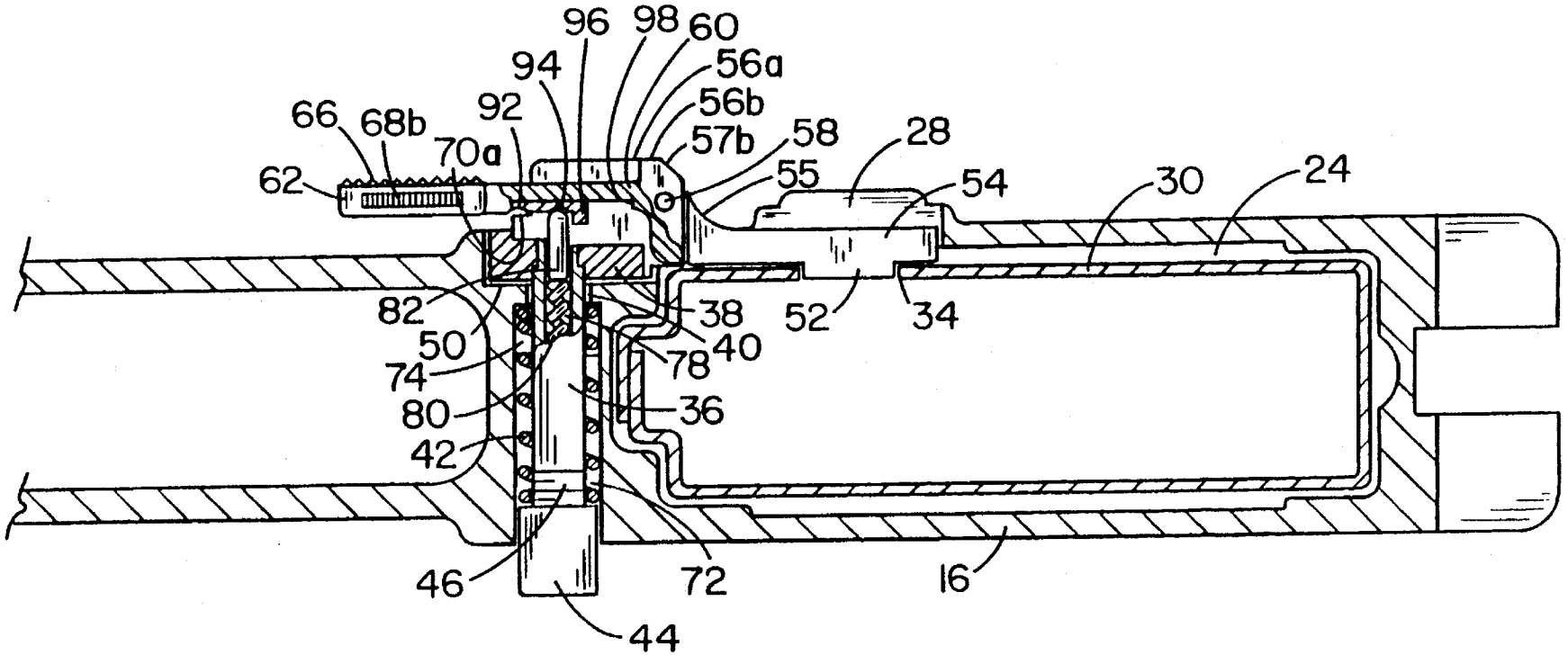
FIG. 6 is a partial longitudinal cross-section view taken along line 2—2 of FIG. 2, showing my magazine release engaged with a magazine and "un-locked"
Figure 7:
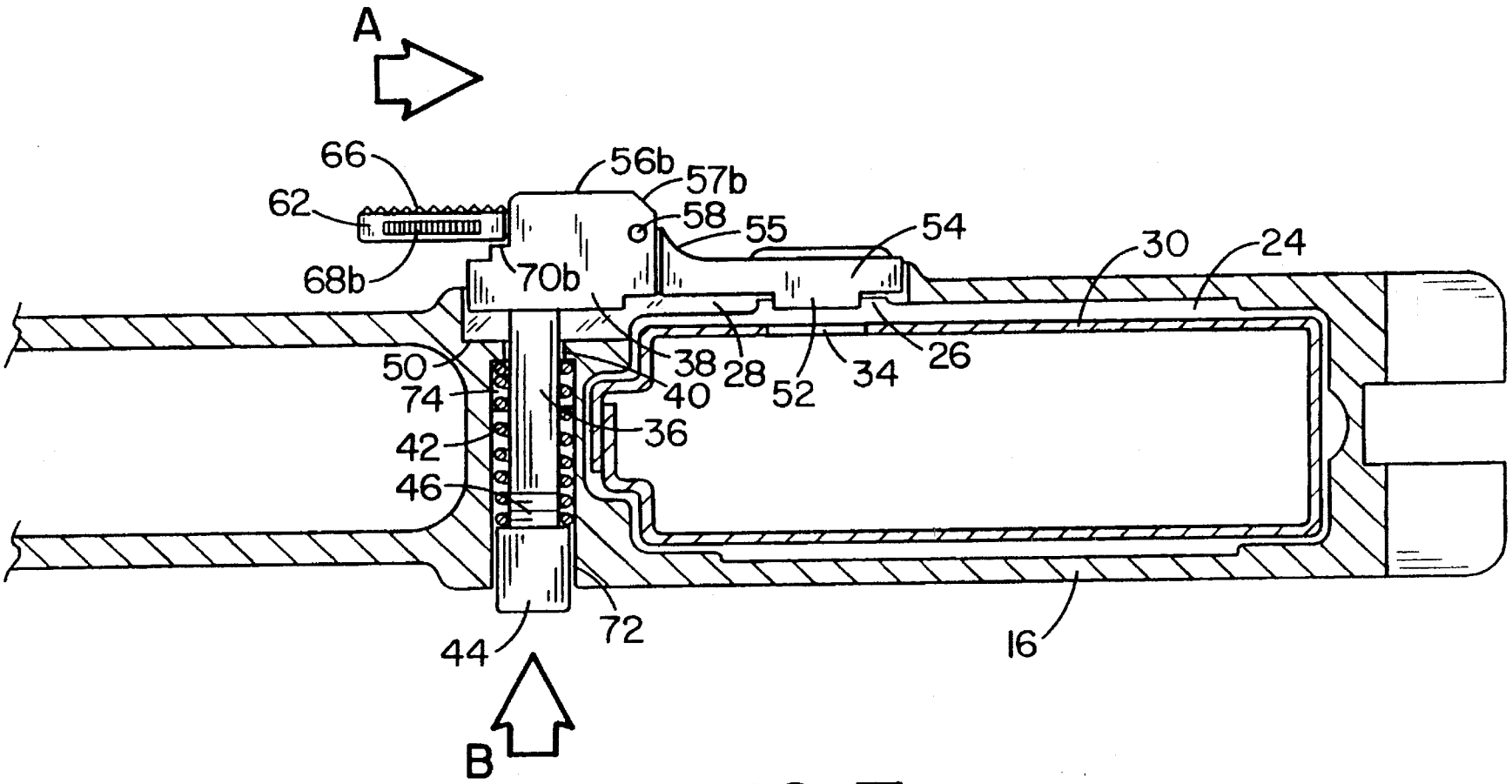
FIG. 7 is a similar partial longitudinal cross-section view taken along line 2—2 of FIG. 2, showing my ambidextrous magazine release in a "locked" condition and the manner in which the magazine is released by pushing on an operating push-button.
Figure 8:
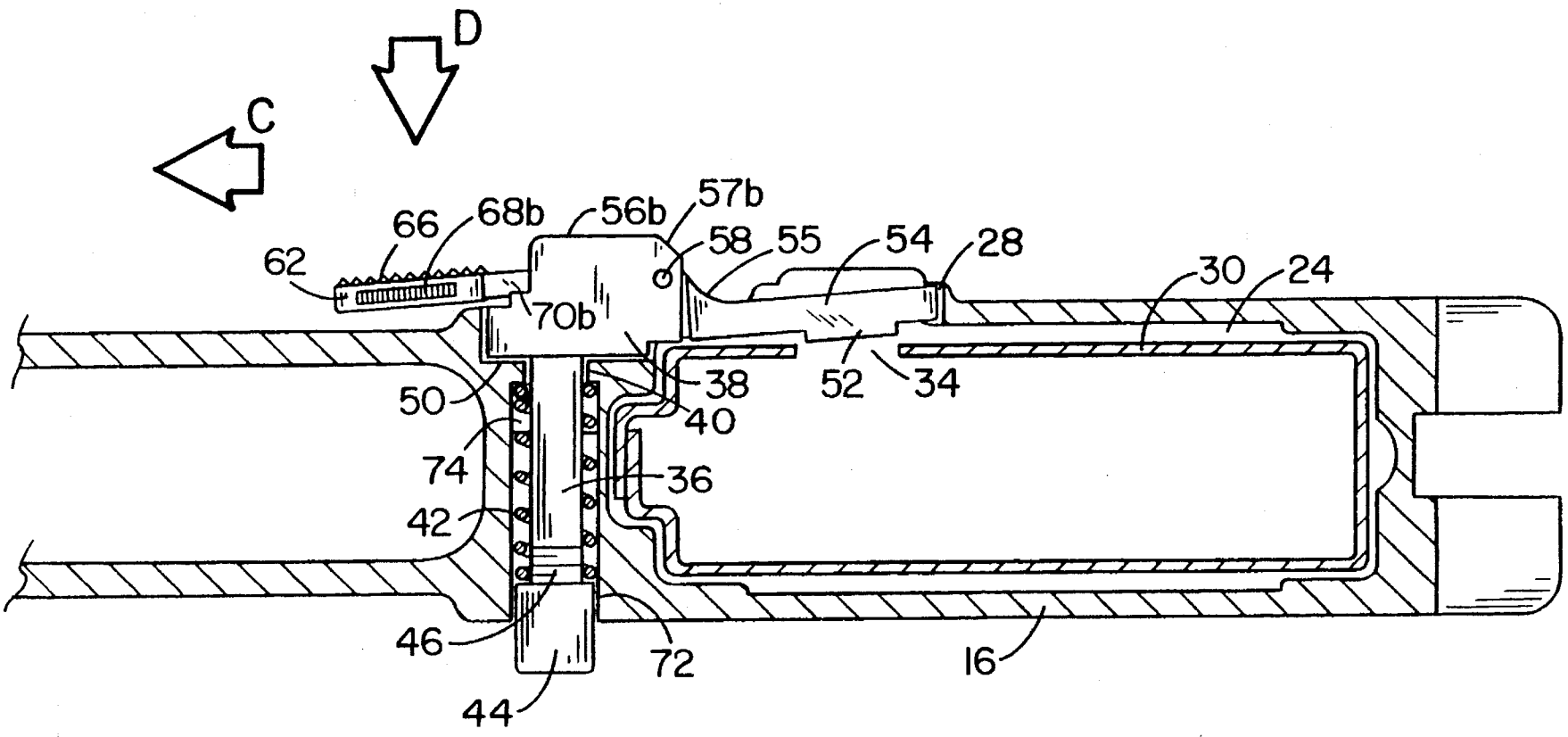
FIG. 8 is another partial longitudinal cross-section view taken along line 2—2 of FIG. 2, showing the manner in which the magazine is released by depressing a slide portion of my magazine release while in an "unlocked" condition.
Figure 10:
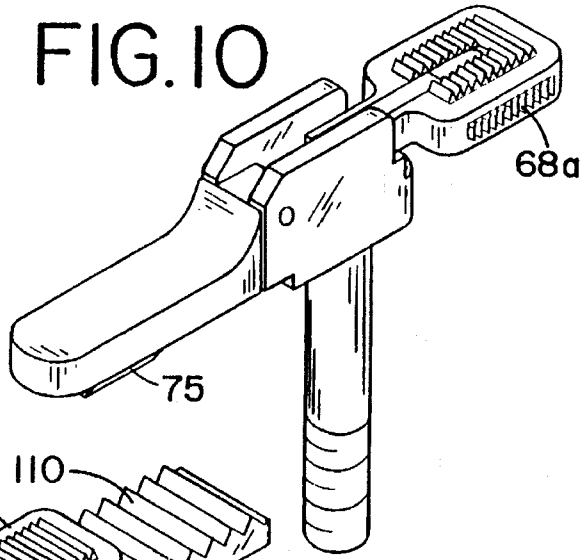
FIG. 10 is a perspective view of the preferred embodiment.

FIG. 6 illustrates a condition in which tooth 52 is engaged with lateral securing slot 34 securing magazine 30 within magazine well 24. Slide 62 is located to the rear allowing the "left-handed" shooter to depress slide 62 with the index finger of his "firing-hand" while in its normal position on the pistol grip. The existing operating push button 44 is already accessible to the index finger of the "firing-hand", of a "right-handed" shooter, while in its normal position on the pistol grip. The removal or insertion of magazine 30 may be brought about by depressing either operating push button 44 or slide 62. In the first case, it is sufficient to press operating push button 44 in the direction of arrow B in FIG. 7. In the second case, it is sufficient to depress slide 62 in the direction of arrow D in FIG. 8. To "lock-out" the ambidextrous function, slide 62 is moved in the direction of arrow A in FIG. 7, until fully retracted. This positions the forward edge of slide 62 over locking shelves **70*a* and 70*b* restricting the movement of slide 62 in the direction of arrow D in FIG. 8. To re-activate the ambidextrous function, slide 62 is moved in the direction of arrow C in FIG. 8** until fully extended.

Thus the reader will see that my ambidextrous magazine release can be easily operated from either side of a firearm by both "right-handed" and "left handed" shooters, in a similar manner. The reader will also note that my magazine release is virtually self-contained and incorporates design features that reduce the possibility of accidental release of a magazine and snags from foliage and equipment. My magazine release is readily adaptable to existing firearms and enhances a "left-handed" or "right-handed" shooter's ability to execute a magazine change.

While the description above contains many specificities, these should not be construed as limitations on the scope of the invention, but rather as an exemplification of one preferred embodiment thereof. Many other variations are possible.

ADDITIONAL RAMIFICATIONS—FIGS. 9–15

Figure 9:
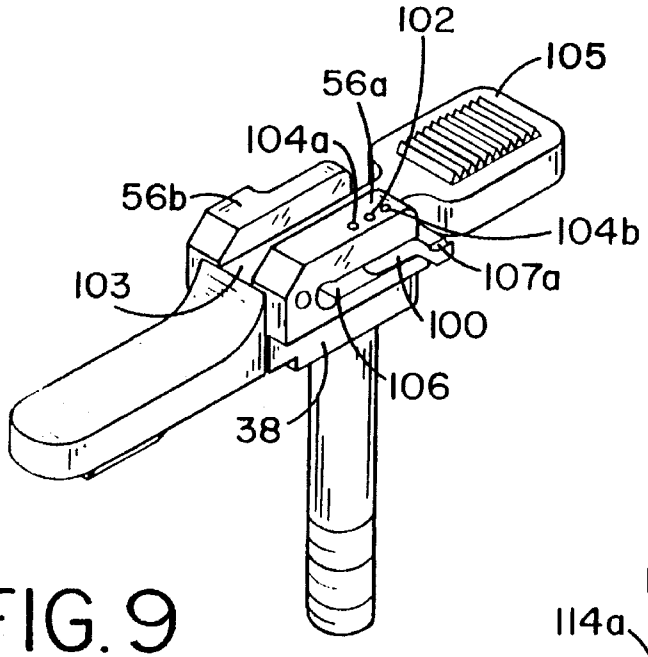
FIG. 9 is a perspective view of an alternative embodiment having a "pivotal" locking device and reinforced protective ears.

For example, the alternative embodiment shown in FIG. 9 incorporates the use of a "T" shaped pivotal lock 100 which is pivotally affixed within a housing slot 106 of the reinforced protective ear **56*a* by means of a pivot pin 102. Engagement of pivotal lock 100 under a one-piece lever 103 is maintained by a ball detent 104*b*. Retraction into housing slot 106 is maintained by a ball detent 104*a*. Both detent 104*a* and detent 104*b* engage a slot (not shown) milled into the top of pivotal lock 100. A notch 107*a* and 107*b* (not shown) is provided at the end of each leg of the "T" to aid in engagement and disengagement of pivotal lock 100**.

Operation of this embodiment is similar to that of the preferred embodiment with the exception of the "lock-out" device. To engage pivotal lock 100, the shooter uses a fingernail in notch **107*b* (not shown) to pull or rotate pivotal lock 100 out of housing slot 106. Rotation continues until ball detent 104*b* engages a slot (not shown) milled into the top of pivotal lock 100. When fully seated, one leg of pivotal lock 100 will positively block depression of lever 103 and the opposite leg will be accessible for disengagement. A reverse order of operation is used to disengage pivotal lock 100. Pivotal lock 100 is fully disengaged when ball detent 104*a* engages a slot (not shown) milled into the top of pivotal lock 100**.

An advantage of this embodiment is that a depressable portion 105 is part of lever 103 and is, therefore, more durable. The same holds true for the increased thickness of protective ears **56*a* and 56*b*. Pivotal lock 100** is reusable and positive but could be difficult to use in extreme weather conditions.

Figure 11:
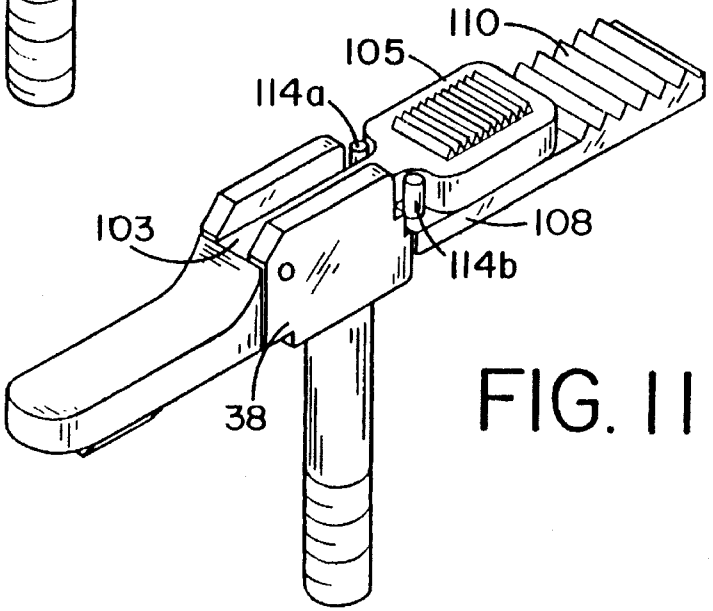
FIG. 11 is a perspective view of another alternative embodiment having a one-piece lever and a simple removable (polymer) locking device.
Figure 14:
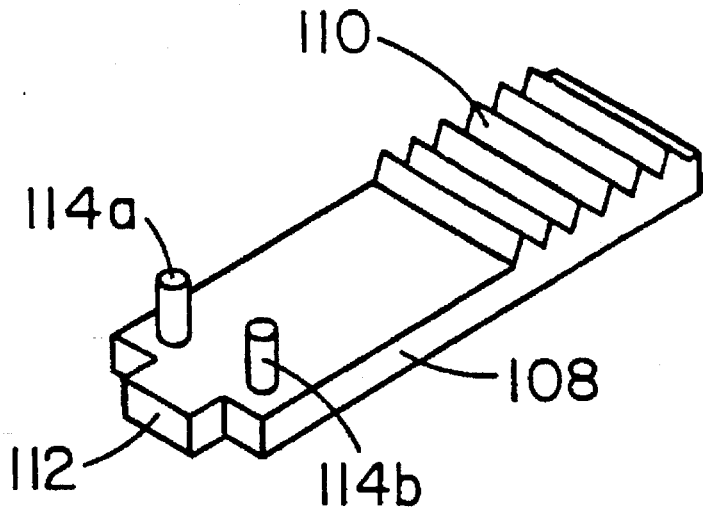
FIG. 14 is a perspective view of the removable (polymer) locking device shown in FIG. 11.

A third embodiment depicted in FIG. 11 satisfies the "lock-out" requirement by way of a removable lock 108. This simple removable lock 108, shown clearly in FIG. 14, is provided with a serrated surface 110, on one end, and a tab 112 on the opposite end. Tab 112 is placed between lever 103 and base 38, restricting depression of lever 103. A pair of stationing protrusions **114*a* and 114*b* are provided to restrict rearward and radial movement of removable lock 108 to maintain positive engagement of tab 112 between lever 103 and base 38**.

To engage removable lock 108, the shooter simply places tab 112 between lever 103 and base 38 until stationing protrusions **114*a* and 114*b* are positioned just forward of depressable portion 105 of lever 103. The preferred material for manufacturing would be a semi-hard polymer. The use of a semi-hard polymer would allow for a slight bending of removable lock 108 needed to correctly position stationing protrusion 114*a* and 114*b*. To disengage removable lock 108, the shooter simply grasps serrated surface 110** and pulls. This pulling action would bend stationing protrusions 114*a* and 114*b* allowing for complete removal of removable lock 108.

One of the advantages of the embodiment shown in FIG. 11, is that it would be simple to manufacture. Like the embodiment depicted in FIG. 9, the embodiment depicted in FIG. 11 would contain less moving parts and would therefore be more durable. One disadvantage of the "simple" removable lock 108, shown in FIG. 11, could be a difficulty to remove it in extreme-cold weather conditions, when the wearing of gloves is mandatory. A removable lock could also be lost. The simple nature of the removable lock's design and construction, however, would make replacement extremely affordable. As previously discussed, the "lock-out" feature is really only necessary until the paratrooper has completed his landing. The loss of the removable lock after this action is of no real consequence.

Figure 12:
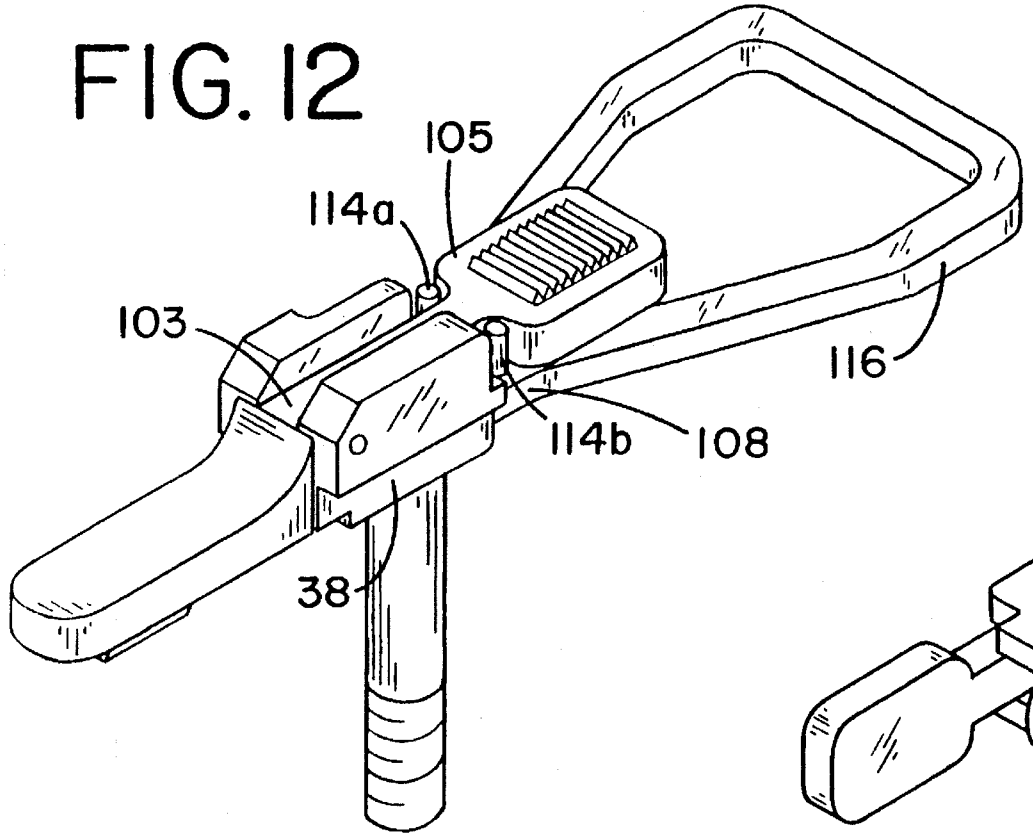
FIG. 12 is a perspective view of yet another alternative embodiment having a one-piece lever, reinforced protective ears and a larger "pull-ring" type (polymer) removable locking device.
Figure 15:
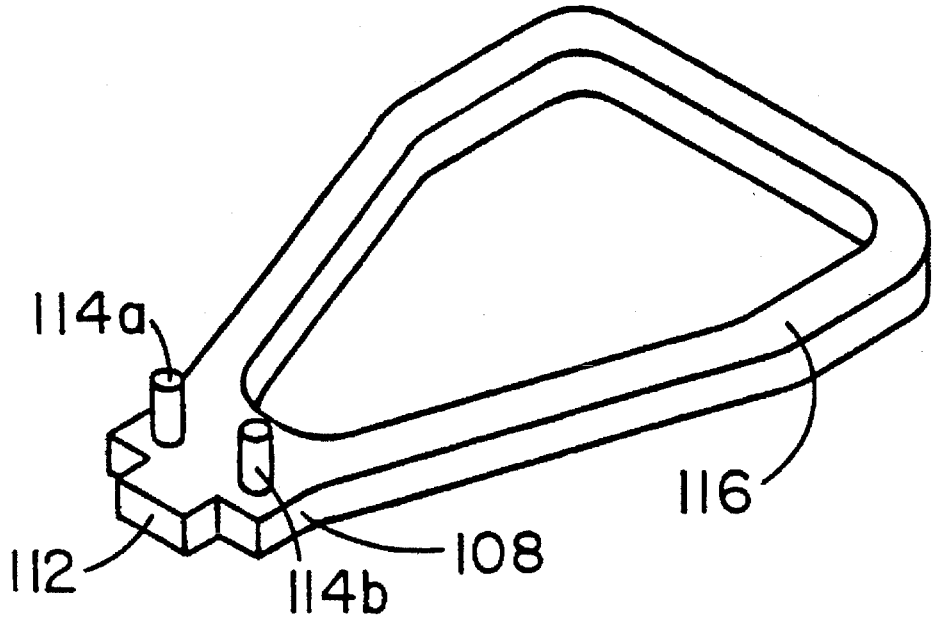
FIG. 15 is a perspective view of the larger "pull-ring" type (polymer) removable locking device shown in FIG. 12.

The embodiment shown in FIG. 12 is similar to the that of the embodiment shown in FIG. 11. The one exception is that instead of a serrated surface, removable lock 108 is provided with a pull ring 116 shown clearly in FIG. 15. Pull ring 116 is constructed so that a "gloved" finger can be easily inserted.

Figure 13:
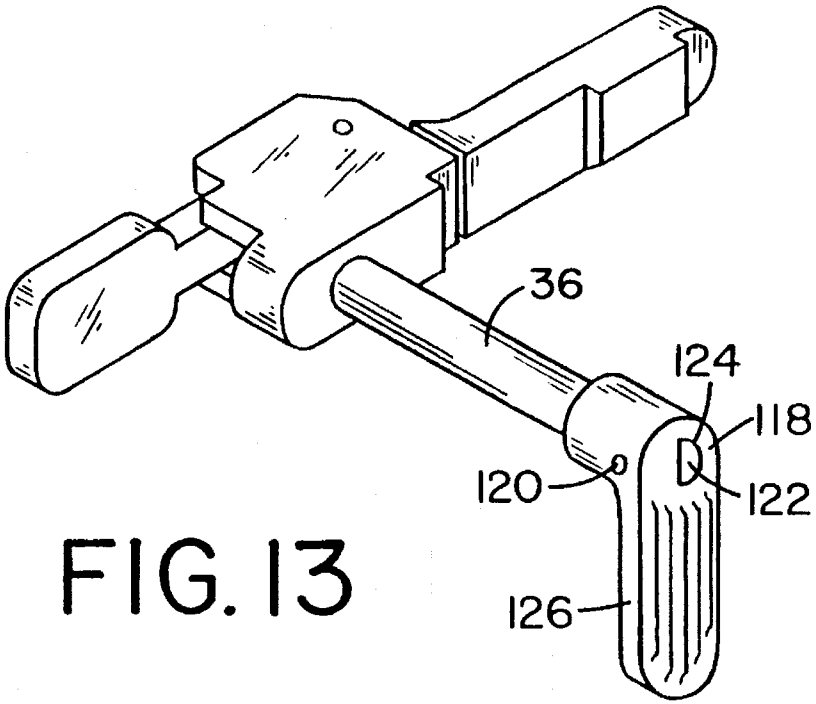
FIG. 13 is a perspective view of a fourth alternative embodiment incorporating the use of a "cap and pin" method of securing an elongated operating push button to the shaft.

The last embodiment, depicted in FIG. 13, differs only in the construction of the operating push button and the method by which it is attached to shaft 36. An elongated operating push button 118 is constructed so that it fits over the end of shaft 36. The end of shaft 36 is provided with a half-moon protrusion 122 that is inserted into a half-moon socket 124, formed in elongated push button 118, and attached by means of a securing pin 120.

The operation of this embodiment is similar to those previously discussed. One advantage of this embodiment is that by changing the position of the half-moon protrusion 122 of shaft 36, a pressable portion 126 can be oriented radially to any one of several positions that would afford the best possible access, of the button, to the shooter's "trigger finger" (index finger) while his "firing hand" is positioned on the pistol grip.

This embodiment overcomes the problems encountered when using an automatic and or semi-automatic rifle that is fitted with a folding stock that is folded back against the side of the firearm. Since the rifles using this folding stock concept are not widely used, this embodiment was not mentioned in the main description. In some cases, as is with the Beretta rifle discussed in U.S. Pat. No. 4,615,134 (Oct. 7,1986) to Beretta, the stock ends up on the same side as the operating push button when folded. By elongating and rotating the operating push button to an accessible position, this embodiment of my invention allows for depression of the operating push button even when the stock is folded against the side of the rifle as described in U.S. Pat. No. 4,615,134 to Beretta. This embodiment makes the use of dries with a folding stock, truly ambidextrous as this embodiment can be easily manipulated form either side of the rifle by "right-handed" or "left-handed" shooters, with a stock folded against the side of the rifle or extended. This embodiment of my invention also improves the ability of the shooter to remove and replace magazines when using rifles such as the Heckler and Koch Models 91 and 93 and the Beretta rifle, previously discussed. These rifles have an operating push button mounted too far forward to be depressed by the "index finger" of the "firing hand", while in its normal position on the pistol grip. By orienting elongated operating push button 118 to the rear, the shooter will be able to reach the pressable portion of the release on either side of the rifle, with the same ease afforded by the M16, AR-15 and other standard "NATO" firearms.

Accordingly, the scope of my invention should be determined not by the embodiments illustrated, but by the appended claims and their legal equivalents.

SUMMARY

It should, therefore, be clear to the reader that the structure of my invention will enable "left-handed" and "right-handed" shooters to release and retain magazines in the fastest possible manner, by reducing the excess movements required to change a magazine with existing release mechanisms. Furthermore, the structure of my invention has additional advantages in that

- it requires no special tools or expertise to install;
- it is readily adaptable to a wide range of "NATO" firearms currently in production;
- the pressable portion is accessible by the index finger of the "firing-hand" while in its normal position on the pistol grip, for both "left-handed" and "right-handed" shooters;
- it can also be manipulated by the thumb of the hand used to remove the magazine;
- it can be configured to overcome the disadvantages associated with the use of a folding stock;
- it provides a positive "lock-out" function to eliminate the chance of accidental release associated with the attaching of a firearm to a paratrooper's harness for airborne operations;
- it provides a "left-handed" shooter, using a sling, with the same ability to change magazines as his "right-handed" counterpart;
- it contains elements that protect the pressable portion from accidental depression;
- it incorporates design features that make the assembly less prone to snagging from foliage and equipment.
- it can be configured for use in "European" designed firearms providing ambidextrous accessibility to the index finger of the "firing-hand" while in its normal position on the pistol grip, where none exists with mechanisms currently in use.

I claim:

1. An ambidextrous magazine release and retaining mechanism for use with a gun, comprising:

a rod having first and second ends transversely and slidably mounted within the gun;

a first spring for biasing the rod towards the first end thereof;

a pushbutton connected to the first end of the rod for pushing the rod against the bias of the first spring;

a base connected to the second end of the rod;

a lever having first and second ends;

the first end of the lever for engaging with the magazine and the second end of the lever including a pressing surface which when pressed towards the gun moves the first end of the lever away from the magazine, the pressing surface of the second end of the lever disposed exterior to the gun and directly pressable by a user;

a pivot between the first and second ends of the lever mounting the lever to the base; and a second spring for biasing the lever so that the first end thereof is biased towards the magazine.

2. A mechanism according to claim 1, further comprising:

a slidable member, connected to the lever, having the pressing surface thereon.

3. A mechanism according to claim 2, wherein the base includes a locking shelf for preventing the lever from pivoting when the slidable member is positioned towards the pivot point of the lever.

4. A mechanism according to claim 1, wherein said lever includes a hole and the base includes:

a pivot pin; and first and second walls each having holes therethrough for holding the pivot pin which passes through said hole in the lever.

5. A mechanism according to claim 1, wherein the rod, base and lever are arranged such that when the pressing surface of the lever is pressed, the lever pivots without moving the rod.

6. A mechanism according to claim 1, wherein the rod, base and lever are arranged such that when the push button is pressed towards the gun, the base moves away from the gun without the lever pivoting.

7. A mechanism according to claim 1, wherein:

the lever has a rounded surface on the first end thereof, the rounded surface facing away from the gun.

8. A mechanism according to claim 1, including a removable lock.

9. A mechanism according to claim 8, wherein:

the removable lock is constructed entirely of a flexible polymer.

10. A mechanism according to claim 9, wherein:

the removable lock includes one or more stationing protrusions.

11. A gun having an ambidextrous magazine release and retaining mechanism, comprising:

a gun body for accepting a magazine;

a rod having first and second ends transversely and slidably mounted within the gun body;

a first spring for biasing the rod towards the first end thereof:, a pushbutton connected to the first end of the rod for pushing the rod against the bias of the first spring;

a base connected to the second end of the rod;

a lever having first and second ends;

the first end of the lever for engaging with the magazine and the second end of the lever including a pressing surface which when pressed towards the gun moves the first end of the lever away from the magazine, the pressing surface of the second end of the lever disposed exterior to the gun and directly pressable by a user;

a pivot between the first and second ends of the lever mounting the lever to the base; and a second spring for biasing the lever so that the first end thereof is biased towards the magazine.

12. A gun according to claim 11, further comprising:

a slidable member, connected to the lever, having the pressing surface thereon.

13. A gun according to claim 12, wherein the base includes a locking shelf for preventing the lever from pivoting when the slidable member is positioned towards the pivot point of the lever.

14. A gun according to claim 11, wherein said lever includes a hole and the base includes:

a pivot pin; and first and second walls each having holes therethrough for holding the pivot pin which passes through said hole in the lever.

15. A gun according to claim 11, wherein the rod, base and lever are arranged such that when the pressing surface of the lever is pressed, the lever pivots without moving the rod.

16. A gun according to claim 11, wherein the rod, base and lever are arranged such that when the push button is pressed towards the gun body, the base moves away from the gun body without the lever pivoting.

17. A gun according to claim 11, wherein:

the lever has a rounded surface on the first end thereof, the rounded surface facing away from the gun body.

18. A gun according to claim 11, including a removable lock.

19. A gun according to claim 18, wherein:

the removable lock is constructed entirely of a flexible polymer.

20. A gun according to claim 19, wherein:

the removable lock includes one or more stationing protrusions.

* * * * *